United States Patent [19]

Pessina et al.

[11] 4,366,955

[45] Jan. 4, 1983

[54] LOADER FOR SIGNATURES

[76] Inventors: Giorgio Pessina; Aldo Perobelli, both of Paderno-Dugnano, Italy

[21] Appl. No.: 146,766

[22] Filed: May 5, 1980

[30] Foreign Application Priority Data

May 18, 1979 [IT] Italy ..... 22806 A/79

[51] Int. Cl.[3] ..... B65H 5/22

[52] U.S. Cl. ..... 271/7; 271/10; 271/150; 271/162; 271/200

[58] Field of Search ..... 271/3.1, 3, 4–7, 271/10, 150, 151, 162, 200; 198/459, 461, 462, 627

[56] References Cited

U.S. PATENT DOCUMENTS

| | | | |
|---|---|---|---|
| 3,756,591 | 9/1973 | Müller | 271/3.1 X |
| 3,894,732 | 7/1975 | Müller | 271/10 |
| 3,929,219 | 12/1975 | Malcolm | 271/200 X |
| 3,945,633 | 3/1976 | Knopp | 271/150 X |
| 4,081,181 | 3/1978 | Crowe | 271/3.1 |
| 4,177,982 | 12/1979 | Bewersdorf | 271/151 X |

*Primary Examiner*—Richard A. Schacher
*Attorney, Agent, or Firm*—Bertram Frank

[57] ABSTRACT

A loader for signatures, loose sheets, gathered sheets and the like, in particular for collating, pamphletizing, stitching and similar bookbinding machines, which can be moved in an automated manner with respect to the bookbinding machine when switching from one size format of the signatures or the like to another. The loader comprises a frame carried in a displaceable fashion by a fixed base, preferably through rolling bearings. The displacement is accomplished by means of an electric motor associated with a threaded rod cooperating with a nut attached to the movable frame of the loader.

7 Claims, 1 Drawing Figure

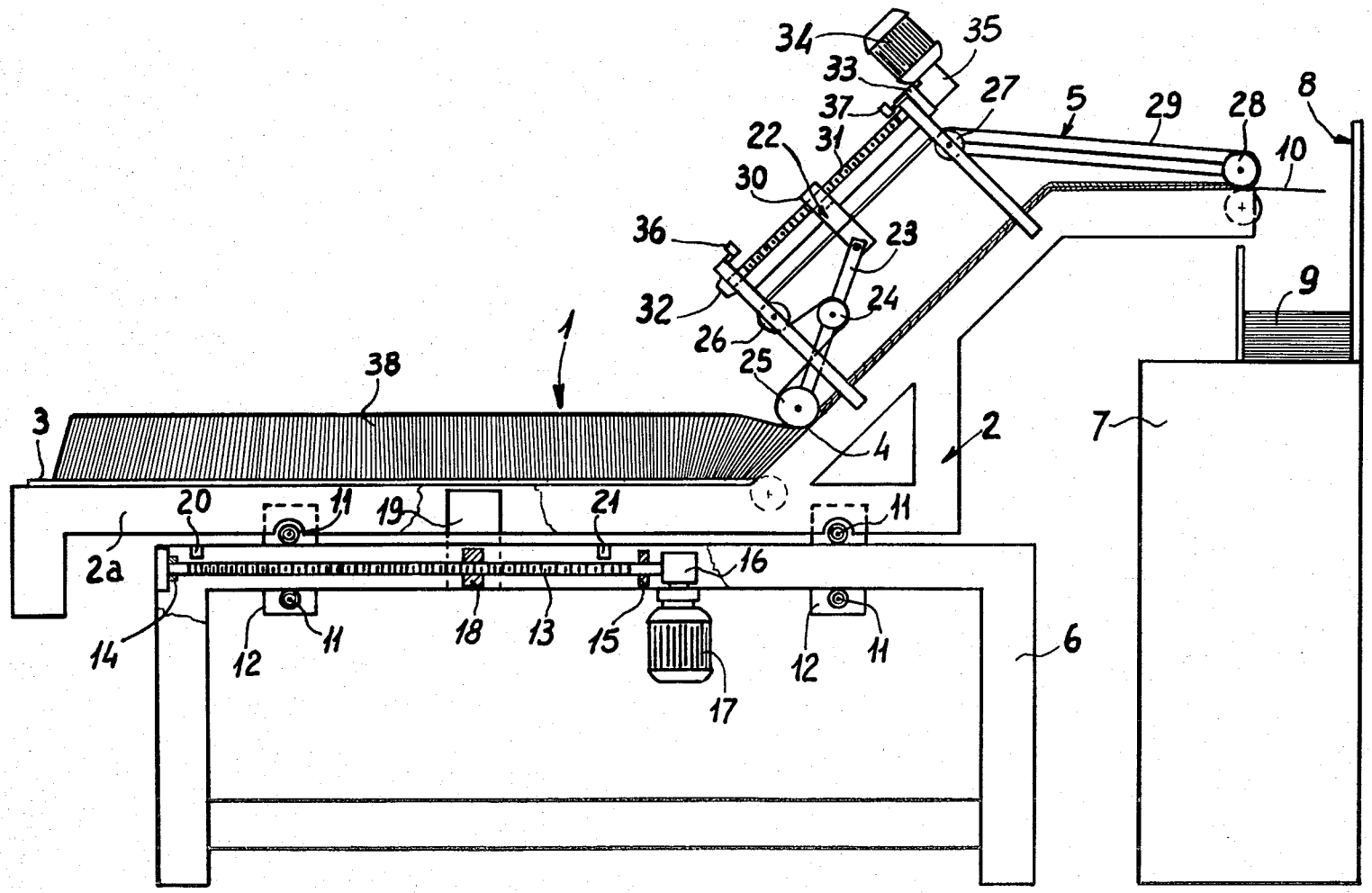
8
10
9
28
29
5
7
6
35
27
2
34
33
37
31
23
24
4
11
11
12
22
30
25
26
16
17
36
32
15
21
1
13
18
19
38
11
11
12
20
2a
14
3

LOADER FOR SIGNATURES

BACKGROUND OF THE INVENTION

This invention relates to a loader for signatures, loose sheets, gathered sheets or pamphletized sheets, and the like, particularly for use on collating, pamphletizing, stitching, and similar bookbinding machines.

Loaders of the above general type are known per se. These comprise basically a supporting frame, a belt feeder, elevator belts, and associated transport device. Such known loaders are mounted on wheels for mobility, and each of them forms an individual loading unit adapted for association with, for example, the feeders of collating machines, pamphletizing machines, book-sewing machines, as well as other related bookbinding machinery. Some of these machines are equipped with bins or stations for receiving and stacking signatures therein, machines with from one to several such bins being quite common. Each bin is fed either manually or from a loader associated with it, the loader being positioned manually in front of its related bin by pushing and guiding it along on its own wheels. The time required for manually adjusting each loader is considerably long, being in the order of some 10 minutes. Such manual adjustments of the loaders become necessary whenever one switches from one size format of the signatures, or the like, to a different one. Switching to different size signatures, or the like, also involves manual adjustment of the conventional supporting and adjusting wheels of the signature transport device, the foremost of said wheels, facing the input end of the elevator belts, having the function of aiding in the engagement with the first signature, and the following ones acting as mere supporting elements.

In currently used loaders of conventional design, in addition to the considerable overall time required for adjusting all of the loaders associated with a given bookbinding machine, a major disadvantage is that, to allow for the cited adjustment of the transport device, a gap must be left between any two successive feeders, for example in the order of 35–40 centimeters and above, which reflects particularly disadvantageously on the overall length of the collating, or similar, machine, whose length may well exceed by over 30% the length it would have if said gaps between successive loaders could be taken up.

OBJECTS OF THE INVENTION

This invention sets out to provide a loader for signatures, loose sheets, gathered sheets, and the like, as specified in the preamble, which while obviating the disadvantages and shortcomings of conventional loaders, also afford automatic adjustment capabilities both of the loader and the transport device, thereby drastically reducing the time required to adjust all the loaders affected by a switch or change from one type of signature, or the like, to another.

SUMMARY OF THE INVENTION

Within that general aim, it can be arranged, moreover, that the loader of this invention has more compact overall dimensions.

According to one aspect of this invention, there is provided a loader for signatures, or the like, particularly for use on bookbinding machines such as collating, pamphletizing, stitching and similar machines, said loader comprising a supporting frame, a belt feeder and elevator belts with associated transport device, characterized in that said supporting frame of the feeder and elevator belts of the transport device is movably carried for adjustable movement by actuating means on a stationary base member, means for controllably translating said transport device being also provided.

Other advantageous aspects and variants of the loader according to this invention may be inferred from the appended subordinate claims.

BRIEF DESCRIPTION OF THE DRAWINGS

Further features, details and advantages of the loader for signatures and the like, according to this invention, will be more clearly understood from the description which follows, relating to the inventive loader which is illustrated diagramatically and by way of example only in the accompanying drawing, the one FIGURE whereof shows a side elevation view of the loader for signatures or the like, as associated with a collating machine, some parts being omitted for a clearer view of some details.

DESCRIPTION OF THE PREFERRED EMBODIMENT

With reference to the drawing FIGURE, the loader according to this invention is indicated generally at 1. Contrary to conventional loaders which are movable individually on supporting and translation wheels, this loader includes a frame 2 for supporting feeder belts 3, or elevator belts 4, as well as the transport device, generally indicated at 5, which is movable on a fixed base member 6 along runway elements. A bookbinding machine, e.g. a collating machine, is designated with the reference numeral 7, the numeral 8 designating vertical abutment elements for forming a stack 9 of signatures, or the like, indicated at 10, within a so-called "bin" of the collator 7.

The base 6 has a substantially parallepipedal structure, the sliding movement of the frame 2 on the base 6 taking place, in the example shown, by means of bearings 11 which are carried on each side of the loader by a support 12 integral with said frame 2. The actuating means which are operative to displace the frame 2 over the base 6 comprise, again in the example shown, a threaded rod 13 which is carried in a freely rotatable manner at 14,15 in supports mounted rigidly on the base 6, the threaded rod being connected with one end to a transmission box 16, also affixed to the base 6, which is connected to the output shaft of an electric motor 17, again attached to the base 6. The threaded rod 13 is accommodated in a crosspiece 18 which functions as a nut therefor, said crosspiece being secured with its ends to a respective plate-like supporting element 19 which is fastened at the top, e.g. by means of screws or weldments, to side stringers **2*a* of the movable frame 2. Thus, it will be apparent that by rotating the threaded rod 13, a longitudinal displacement of the frame 2 is produced, in either direction, depending on the direction of rotation of the threaded rod 13. The reference numerals 20,21** designate two safety travel limit switches.

The displacement of the transport device 5, as dictated by the size of the particular signatures or the like being handled, is effected, according to the invention, in an automatic manner by shifting longitudinally the inverted yoke support 22 of parallel arms 23 which carry pulleys 24,25 accommodating, similarly to other pulleys 26,27 and 28, drive cords 29. Through the cross portion 30 of the C-like support 22, there is formed a threaded hole which acts as a nut in receiving the threaded rod 31 which is carried in a freely rotatable manner in supports 32,33 rigid with the frame of the transport device 5. In the exemplary embodiment shown, the support 33 also accommodates the motor 34 through the interposition of a reduction gear drive 35. Also in this instance, a rotation of the threaded rod 31 produces a displacement of the support 22 in either direction depending on the direction of rotation of the rod 31, the numerals 36,37 designating two safety travel limit switches. The displacement of the cited support 22 results in a displacement of the front pulley (or pulleys, if more than one are provided in coaxial arrangement) 25 with respect to the top edges of the signatures 10 in the pack 38.

The operation of the loader according to this invention will be apparent from the description given hereinabove. A re-positioning of the movable part 2 of the loader 1 with respect to the abutment elements of the collator 7, as dictated by a change in the size of the signatures 10, will take place by actuation of the motor 17 in one or the other direction of rotation, which results in the upper delivery point of the loader moving closer to the related bin, or alternatively, away from it.

Likewise, to position the front pulleys 25 with respect to the top edges of the signatures 10 in the fed pack 38, it will be sufficient to control the motor 34 in either direction, thus causing said front pulleys 25 to either approach the pack 38 of signatures or move away therefrom, depending on the size format being handled. In all cases, the adjustment of the position of the movable part of the loader 1 with respect to its associated bin on the collator occurs within a very short and accurately determined time, without the operator having to exert any special effort, and moreover, the desired positioning of the transport device is also accomplished in a simple and quick manner, without the operator having to move to the front of the loader, as was required heretofore, which enables to take up, as a result, the gaps that had to be left between successive loaders. This affords the possibility of reducing by approximately 30% the overall length of a conventional collator, or similar machine, while retaining the output potential thereof.

It will be appreciated from the foregoing that the loader according to the invention effectively achieves the invention objects and advantages as listed in the preamble. The automatic adjustment of the transport device, although referred to a pulley-and-cord type of transport device, may easily be adopted also on transport devices with different configurations.

In practicing the invention, all of the individual parts described may be replaced with other technically or function-wise equivalent parts; thus, for example, the threaded rods and associated crosspiece serving as a nut therefor could be replaced with a rack-and-pinion type control, and moreover, the movement of the supporting structure on the base could be accomplished, rather than by means of rolling elements, through a guide arrangement, e.g. dovetailed guides, while the movable parts of the loader, as well as the transport device, could be configurated other than as shown, without departing from the purview of the instant inventive concept.

Furthermore, it is contemplated that the base may be replaced with simple supporting rails, the translatory movement taking place through the use of racks, linear motors, or in any other known manner.

The dimensions and materials may be selected as desired, still within the scope of the present concept.

All of the features which can be inferred from the above description, accompanying drawing and appended claims are substantial to the invention, either singly or in any combination whatever.

We claim:

1. A loader for signatures, loose sheets, gathered sheets and the like, particularly for use on collating, pamphltizing, stitching and similar bookbinding machines, comprising a loader frame, said loader frame having feeder belts and inclined elevator belts for feeding signatures to the bookbinding machine and provided with an associated transport device, wherein the loader frame has a stationary base member and a supporting frame carrying said feeder belts and elevator belts as well as the associated transport device, said supporting frame being mounted on said base member by rolling means for reciprocating movements thereon, actuating means interposed between said base member and said supporting frame to move the supporting frame relative to said base member and said bookbinding machine to position said supporting frame when switching from one size signature format to another and safety travel limit switches, said switches being positioned on said base member to regulate the movement of the supporting frame relative to said base member.

2. A loader according to claim 1, characterized in that said fixed base is in the form of rails, said rails being either overhead rails or embedded in the floor.

3. A loader according to claim 1 wherein the control means is in the form of switches on the front portion of the loader to translate the moveable support frame.

4. A loader according to claim 1 wherein the control means is in the form of switches on the front portion of the loader to translate the pulleys or wheels of said associated transport device.

5. A loader according to claim 1 wherein said actuating means includes a threaded driving rod carried in said base member in a freely rotatable manner by supports affixed to said base member and accomodated in a crosspiece having a hole acting as a nut therefore and firmly associated with said supporting frame for shifting the latter, whereby said threaded rod is connected by drive means with electric motor means for positioning said supporting frame relative to said base member and to said bookbinding machine.

6. A loader according to claim 5, wherein said threaded rod is centrally arranged above and parallel to said elevator belts.

7. A loader according to claim 1 wherein said rolling means comprise upper bearings integral with the supporting frame and a lower bearing, said bearings engaging said base member.

* * * * *